US008172441B2

(12) United States Patent
Ishida

(10) Patent No.: US 8,172,441 B2
(45) Date of Patent: May 8, 2012

(54) LIGHT EMITTING MODULE OF VEHICLE HEADLAMP

(75) Inventor: Hiroyuki Ishida, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 250 days.

(21) Appl. No.: 11/859,815

(22) Filed: Sep. 24, 2007

(65) Prior Publication Data

US 2008/0074896 A1 Mar. 27, 2008

(30) Foreign Application Priority Data

Sep. 26, 2006 (JP) ..... 2006-260556

(51) Int. Cl.
*F21V 7/00* (2006.01)

(52) U.S. Cl. ..... 362/518; 362/311.02; 362/327; 362/516

(58) Field of Classification Search ..... 362/327, 362/511, 516, 518, 311.02
See application file for complete search history.

(56) References Cited

U.S. PATENT DOCUMENTS

| | | | | |
|---|---|---|---|---|
| 4,914,747 | A * | 4/1990 | Nino | 362/539 |
| 6,547,423 | B2 * | 4/2003 | Marshall et al. | 362/333 |
| 6,724,543 | B1 * | 4/2004 | Chinniah et al. | 359/718 |
| 6,960,007 | B2 * | 11/2005 | Ishida et al. | 362/538 |
| 2004/0160772 | A1 | 8/2004 | Tatsukawa et al. | |
| 2004/0257827 | A1 | 12/2004 | Ishida et al. | |
| 2005/0018445 | A1 * | 1/2005 | Sazuka et al. | 362/545 |
| 2006/0083002 | A1 | 4/2006 | Koike et al. | |
| 2006/0209552 | A1 * | 9/2006 | Okada et al. | 362/509 |

FOREIGN PATENT DOCUMENTS

| | | | |
|---|---|---|---|
| JP | 2001-6408 | A | 1/2001 |
| JP | 2004-247151 | A | 9/2004 |
| JP | 2005-11761 | A | 1/2005 |
| JP | 2005-44683 | A | 2/2005 |
| JP | 2005-228623 | A | 8/2005 |
| JP | 2006-114347 | A | 4/2006 |
| JP | 2006-164923 | A | 6/2006 |

OTHER PUBLICATIONS

Japanese Office Action issued on May 10, 2011 in the corresponding Japanese Patent Application No. 2006-260556.

* cited by examiner

*Primary Examiner* — Diane Lee
*Assistant Examiner* — Sean Gramling
(74) *Attorney, Agent, or Firm* — Sughrue Mion, PLLC

(57) ABSTRACT

A light emitting module used in a vehicle headlamp is provided with a light source having a light emitting plane directing toward a front side of a lighting unit, a projection lens disposed ahead of the light source, and a reflecting plane extending in an oblique and forward direction from a side of the light source. The projection lens is disposed by setting a focal point in a vicinity of a lower side of the light emitting plane. The reflecting plane has a structure so that a light emitted from the light source is reflected toward a lower region from a cut line.

12 Claims, 8 Drawing Sheets

LIGHT EMITTING MODULE OF VEHICLE HEADLAMP

This application claims foreign priority from Japanese Patent Application No. 2006-260556 filed on Sep. 26, 2006, the entire contents of which are hereby incorporated by reference.

BACKGROUND OF THE INVENTION

1. Field of the Invention

The present invention relates to a light emitting module of a vehicle headlamp in which an LED is used as a light source.

2. Related Art

In recent years, an LED which is excellent in a light emitting efficiency and a power consuming characteristic has often been used as a light source of a vehicle headlamp (for example, see JP-A-2005-044683, pages 4-11, FIG. 6). The vehicle headlamp includes a light emitting module with an LED, a projection lens and a reflecting plane.

As shown in FIG. 13, a light emitted from an LED 11 as a light source is diffused within a range of approximately 180 degrees from a light emitting plane. Accordingly, a light which is not incident on a projection lens 21 is wasteful to cause a low efficiency. Therefore, an optical system shown in FIG. 14 has been proposed as measures for efficiently irradiating the light emitted from the LED in a forward direction (for example, see JP-A-2005-228623, pages 3-4, FIG. 2). More specifically, the light which is not incident on the projection lens 22 provided ahead of the LED 12 is reflected by a bowl-shaped reflecting plane 31 which is provided to cover the light source in a forward direction from a side of the light source, and almost all lights are irradiated in the forward direction.

However, a light emitting plane disclosed in the Patent Document 2 is rotationally symmetrical, and the light source and the projection lens are not proper for forming a light distribution pattern with a cut line. Accordingly, there is a problem in that it is impossible to form a necessary low beam light distribution pattern with the cut line when the optical system is mounted as a vehicle headlamp.

SUMMARY OF THE INVENTION

One or more embodiments of the present invention provide a light emitting module to form a proper light distribution pattern in which a diffused light is distributed to a lower side of a cut line.

According to one or more embodiments of the invention, a light emitting module is provided with a light emitting portion having a light emitting plane directing toward a front side of a lighting unit and having at least one distal line, a projection lens disposed in a front side of the light emitting portion, and a reflecting plane extending in an oblique and forward direction from a side of the light emitting portion. The light emitting portion has at least a straight brightness boundary line. The projection lens has a focal point in a vicinity of a lower side of the light emitting plane. The reflecting plane is configured to reflect a light emitted from the light emitting portion toward a lower region from a cut line. According to the structure, it is possible to form a proper light distribution pattern in which a diffused light is distributed to the lower side of the cut line by devising the shapes of the reflecting plane and a light source (the light emitting plane) and a position of the lens. The light emitting portion may be an LED having a rectangular light emitting plane and include a shape in which a shape of an outer edge of the light emitting plane is partitioned by a long line of at least one side.

Further, the projection lens and the reflecting plane may be integrally molded into one piece by a transparent resin. According to the structure, it is not necessary to regulate the relative positions of the projection lens and the reflecting plane during assembling the module, and it is possible to easily form the light emitting module.

Moreover, a diffusion lens for diffusing the light emitted from the light emitting portion in a horizontal direction may be provided ahead of the projection lens and the reflecting plane. According to the structure, particularly, it is possible to generate a proper light distribution pattern in which a diffused light having an expansion in a horizontal direction is distributed to the lower side of the cut line.

In addition, a shade may be disposed ahead of the light emitting portion, and the focal point of the projection lens may be disposed in a vicinity of a side of the shade. According to the structure, it is possible to give a proper cut line for a light distribution pattern by the shade.

According to the embodiments of the invention, it is possible to form a proper light distribution pattern in which a diffused light is distributed to the lower side of the cut line by devising the shapes of the reflecting plane and the light source (light emitting plane) and the position of the lens. Therefore, it is possible to irradiate a low beam having a high safety without generating a dazzling light toward a car running on an opposing lane.

Other aspects and advantages of the invention will be apparent from the following description and the appended claims.

DETAILED DESCRIPTION OF THE EXEMPLARY EMBODIMENTS

Figure 1:
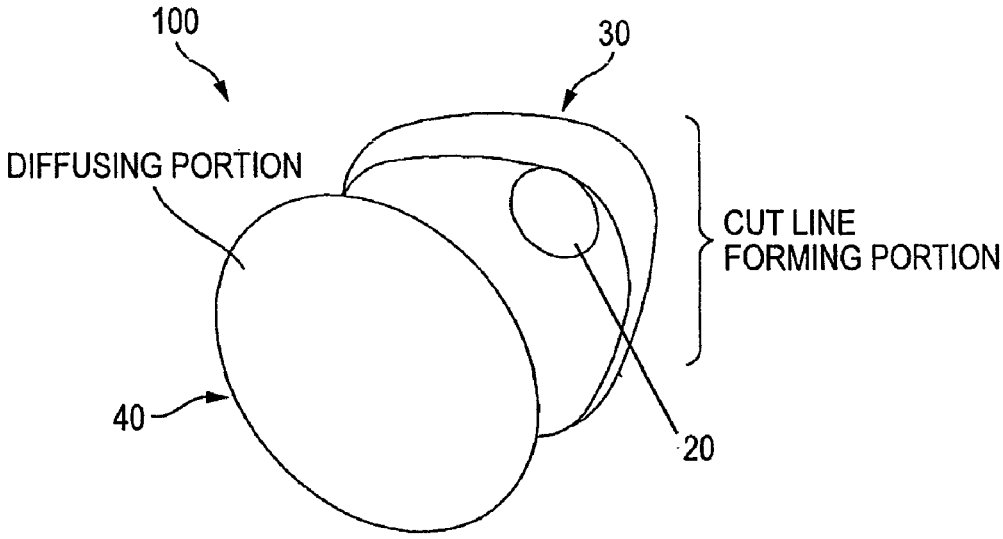
FIG. 1 is a perspective view showing a structure of a light emitting module of a headlamp for a vehicle according to an exemplary embodiment of the invention.

FIG. 1 is a perspective view showing a structure of a light emitting module of a vehicle headlamp according to an exemplary embodiment of the invention. As shown in the drawing, a light emitting module 100 is constituted by a projection lens 20, a reflecting plane 30 and a diffusion lens 40. An LED 10 in a light emitting portion which is not shown is disposed behind the projection lens 20. The projection lens 20 and the reflecting plane 30 function as cut line forming portions for forming a cut line of a light distribution pattern and the diffusion lens 40 functions as a diffusing portion for diffusing a light emitted from a light source.

Figure 2:
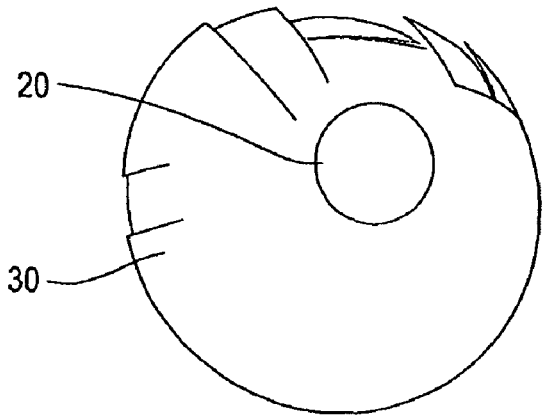
FIG. 2 is a perspective view showing a state in which only a projection lens and a reflecting plane which serve as cut line forming portions are extracted.

FIG. 2 is a perspective view showing only the projection lens 20 and the reflecting plane 30. Differently from the conventional art, the reflecting plane 30 does not have a bowl-shape which is rotationally symmetrical but has a shape of a curved surface having a great curvature in an upper half part. Moreover, an inner surface of the reflecting plane 30 is subjected to a mirror finishing treatment and forms a reflection mirror.

Figure 3:
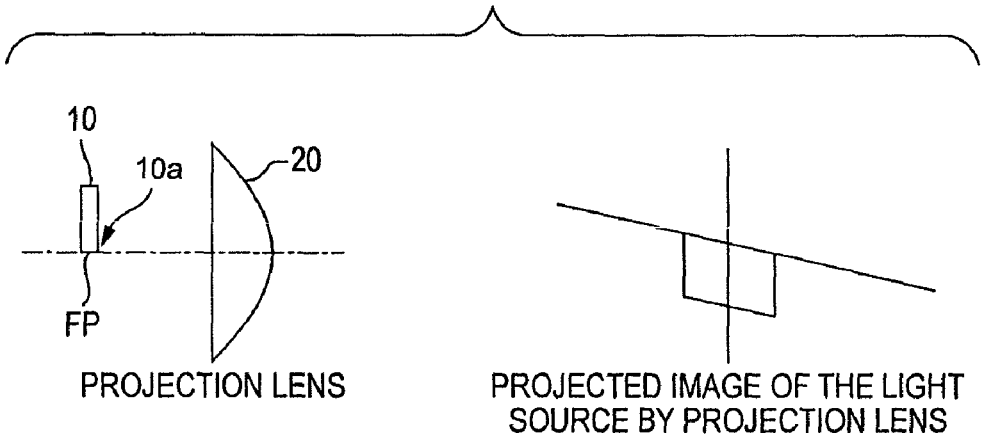
FIG. 3 is a typical view showing a state in which an LED to be a light source is projected by the projection lens.

FIG. 3 is a typical view showing a state in which the LED 10 as the light source is projected by the projection lens 20. Description will be given to a positional relationship between the LED 10 and the projection lens 20. The LED 10 is disposed in such a manner that a long side 10*a* on a lower side of a light emitting plane having an oblong and rectangular shape is positioned in a vicinity of a focal point FP of the projection lens 20. Accordingly, a projected image of the light source generated by the projection lens 20 is positioned on a lower side of an optical axis.

On the other hand, a light which is not incident on the projection lens 20 is reflected by the reflecting plane, that is, the reflection mirror and is thus emitted in a forward direction. In the reflecting plane, a direction of the optical axis, the focal position, and a shape of the reflecting plane are set in such a manner that an image reflected by the reflection mirror is turned downward from an upper side of the image of the projection lens 20. More specifically, as described above, a curvature of an upper curved surface covering an upper side of the projection lens is greater than a curvature of a lower curved surface covering a lower side of the projection lens, and the reflected light does not reach an upper side of the cut line (see FIG. 2). Although the reflecting plane is constituted by a small divided and curved surface in the example of FIG. 2, it is a matter of course that the reflecting plane may be constituted by a smooth and continuous curved surface.

Figure 4:
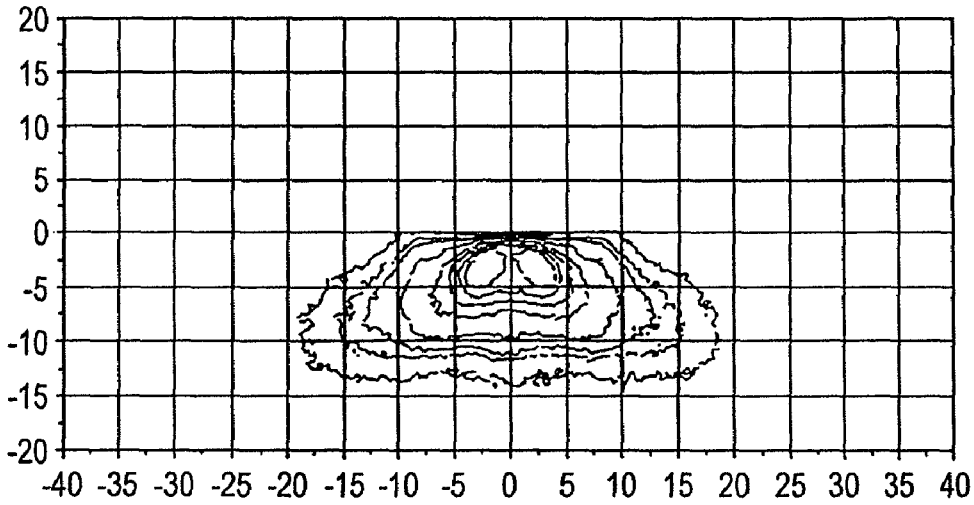
FIG. 4 is a chart showing a light distribution pattern in the cut line forming portion in the light emitting module of the headlamp for a vehicle according to the embodiment of the invention.
Figure 5:
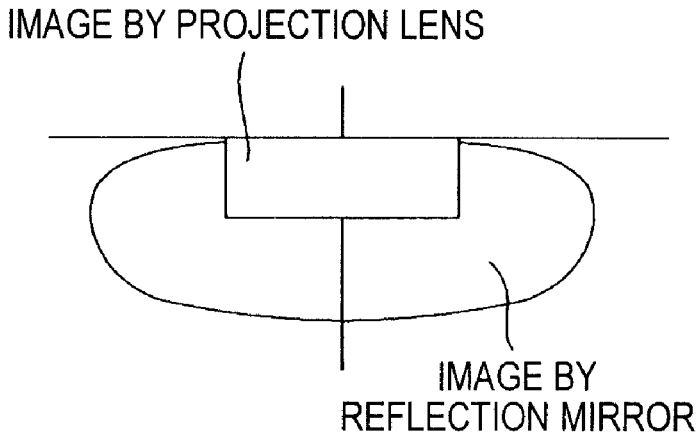
FIG. 5 is a typical view showing a structure of the light distribution pattern.

FIG. 4 is a chart showing a light distribution pattern formed by the cut line forming portion (that is the projection lens 20 and reflecting plane 30) in the light emitting module of the vehicle headlamp according to the exemplary embodiment of the invention. Moreover, FIG. 5 is a typical view showing a structure of the light distribution pattern in FIG. 4. As shown in the drawings, the light reflected by the reflection mirror is distributed to a lower region of a cut line. Therefore, it is possible to irradiate a low beam having a high safety without generating a dazzling light toward a car running on an opposing lane.

Figure 6:
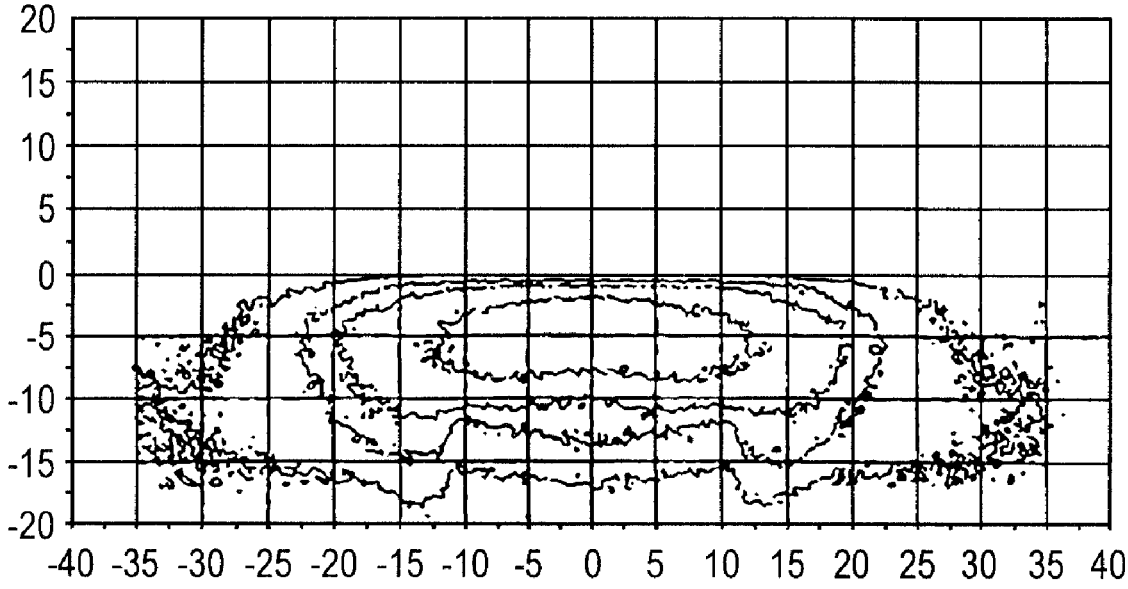
FIG. 6 is a chart showing a light distribution pattern in a diffusing portion in the light emitting module of the headlamp for a vehicle according to the embodiment of the invention.
Figure 7:
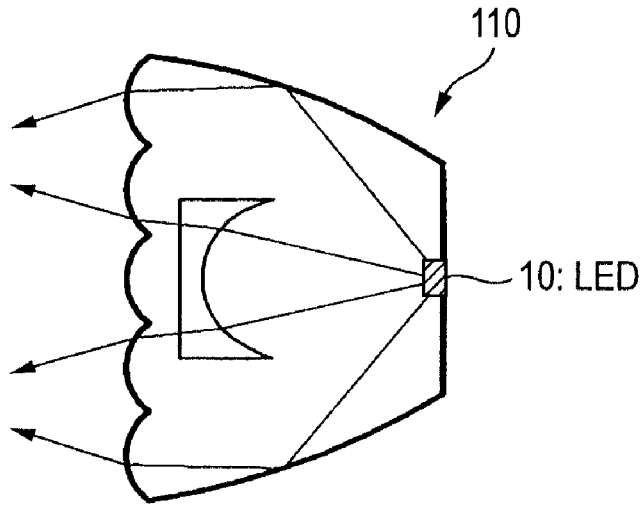
FIG. 7 is a horizontal sectional view showing an example of integral molding in the light emitting module of the headlamp for a vehicle according to the embodiment of the invention (a diffusion lens is provided on a front surface of the projection lens, a light source molding type)
Figure 8:
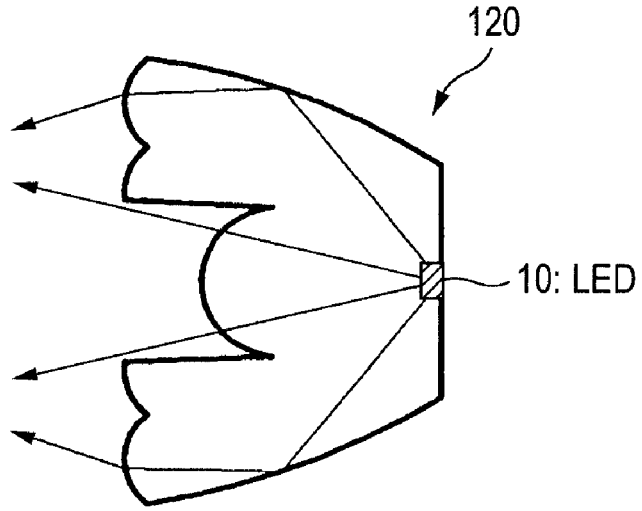
FIG. 8 is a horizontal sectional view showing an example of the integral molding in the light emitting module of the headlamp for a vehicle according to the embodiment of the invention (the diffusion lens is not provided on the front surface of the projection lens, the light source molding type)

FIG. 6 is a chart showing a light distribution pattern formed by the diffusing portion in the light emitting module of the vehicle headlamp according to the exemplary embodiment of the invention. As shown in the drawing, a light is properly diffused in a horizontal direction by the diffusion lens 40.

FIGS. 7 to 10 are horizontal sectional views showing an example of integral molding in the light emitting module of the headlamp for a vehicle according to the exemplary embodiment of the invention. In a light emitting module 110 shown in FIG. 7, a diffusion lens is also formed on a front surface of the projection lens, and the LED 10 (not shown) to be the light source is molded. On the other hand, in a light emitting module 120 shown in FIG. 8, the diffusion lens is not formed on the front surface of the projection lens.

Figure 9:
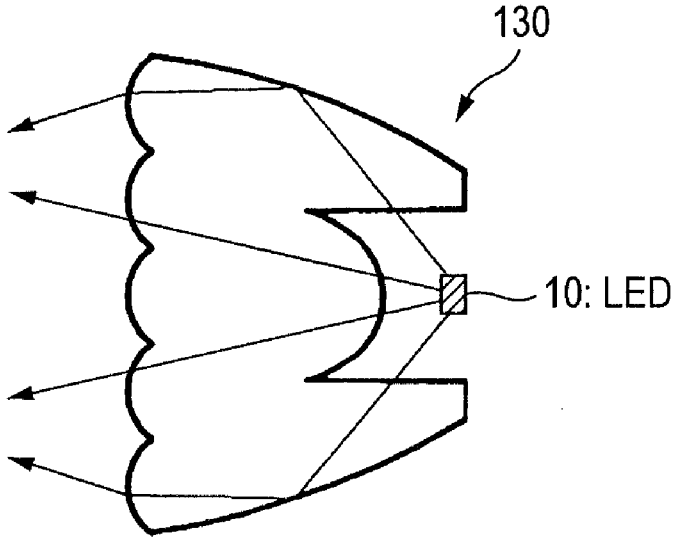
FIG. 9 is a horizontal sectional view showing an example of the integral molding in the light emitting module of the headlamp for a vehicle according to the embodiment of the invention (the diffusion lens is provided on the front surface of the projection lens, a light source non-molding type)
Figure 10:
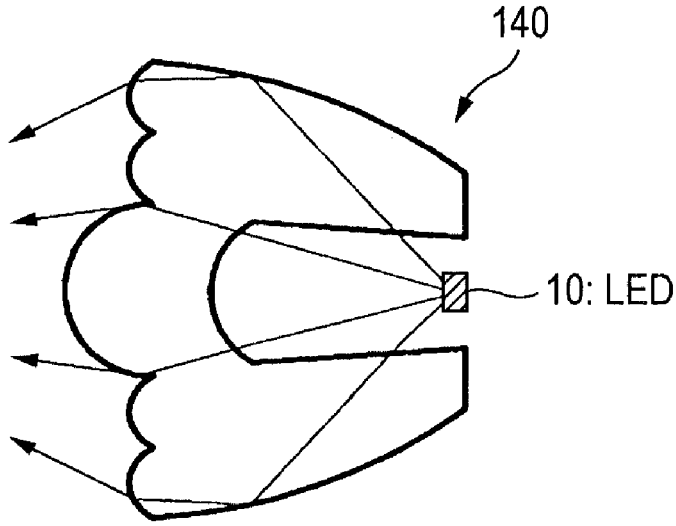
FIG. 10 is a horizontal sectional view showing an example of the integral molding in the light emitting module of the headlamp for a vehicle according to the embodiment of the invention (the diffusion lens is not provided on the front surface of the projection lens, the light source non-molding type)

A light emitting module 130 shown in FIG. 9 has such a structure that the LED 10 (not shown) to be the light source is not molded, and the diffusion lens is formed on the front surface of the projection lens. On the other hand, similarly, a light emitting module 140 shown in FIG. 10 has such a structure that the LED 10 is not molded, and the diffusion lens is not formed on the front surface of the projection lens.

By molding the projection lens and the reflecting plane integrally with each other as described above, it is possible to easily constitute the light emitting module. In particular, the structure in which the LED 10 is not molded is excellent in an assembling property and a maintenance property.

Figure 11:
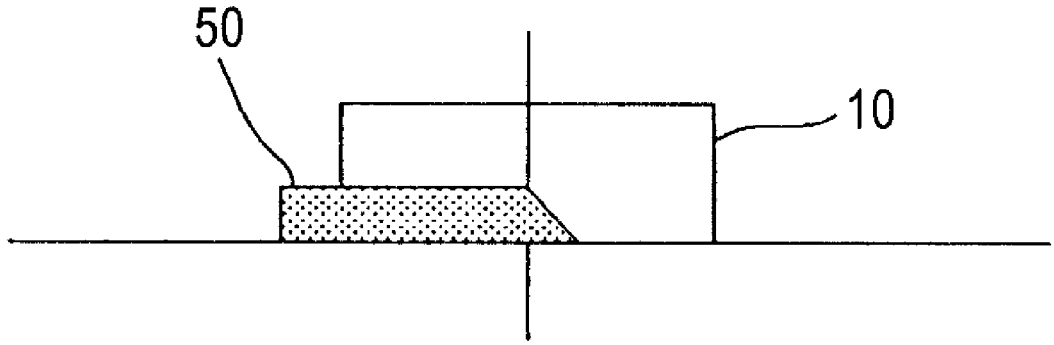
FIG. 11 is a view showing an arrangement of a light source and an optical axis in the case in which a shade is disposed on the front surface of the LED.
Figure 12:
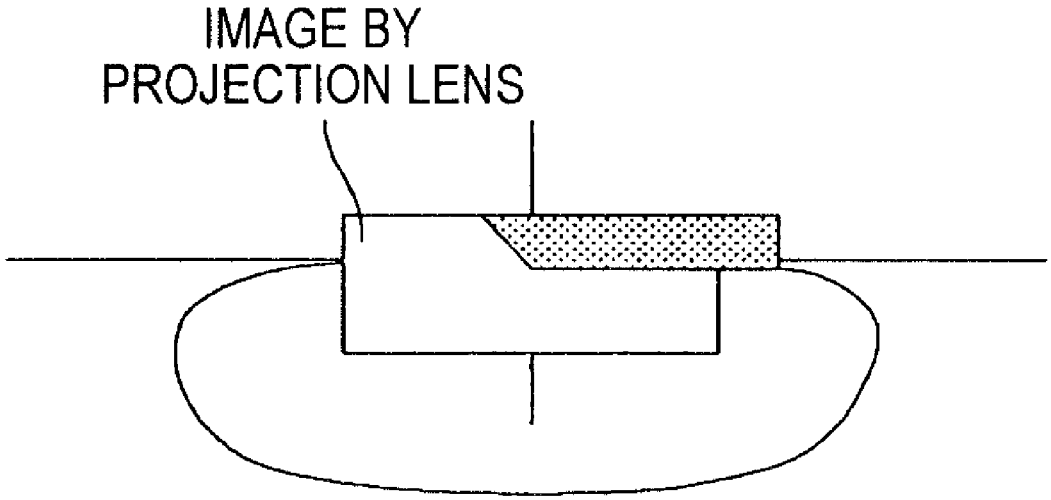
FIG. 12 is a view showing a light distribution pattern in the case in which the shade is disposed on the front surface of the LED.
Figure 13:
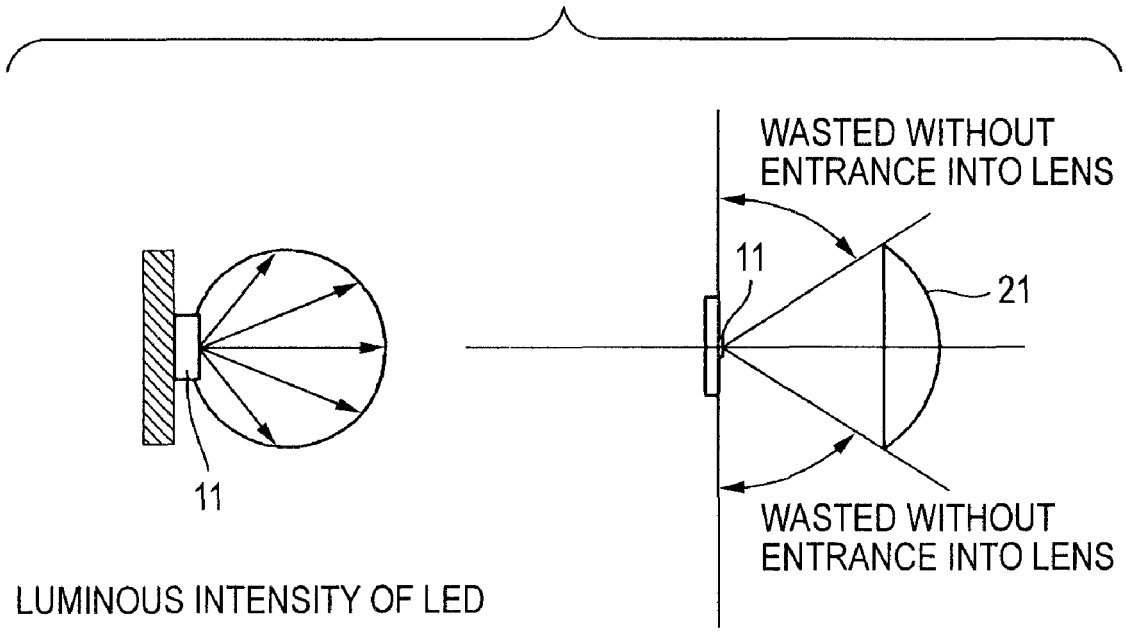
FIG. 13 is a typical view showing a light emitting luminous intensity distribution of the LED.
Figure 14:
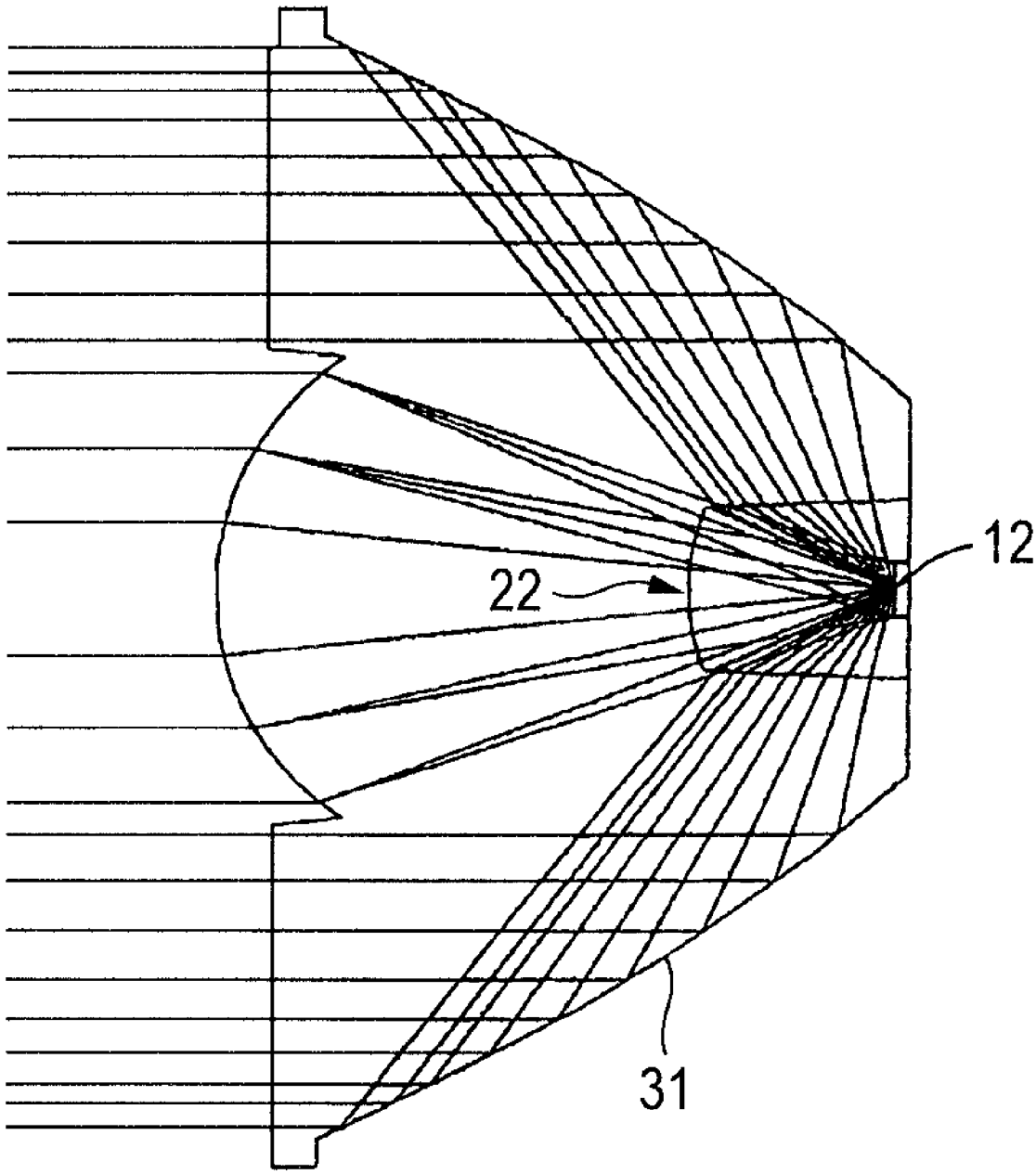
FIG. 14 is a view showing an optical system for efficiently emitting a light from the LED in a forward direction (the prior art).

By disposing a shade 50 on the front surface of the LED 10 and providing a projection lens in such a manner that a side of the shade 50 is coincident with the vicinity of a focal point as shown in FIG. 11, it is also possible to generate a light distribution pattern having a so-called Z-shaped cut line as shown in FIG. 12.

According to the exemplary embodiment, it is possible to obtain a desirable light distribution by forming a light distribution pattern having a cut line through the cut line forming portion constituted by the projection lens 20 and the reflecting plane 30 and carrying out a diffusion in a proper variation through the diffusion lens of the diffusing portion.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF THE REFERENCE NUMERALS AND SIGNS

10, 11, 12 LED
20, 21 projection lens
30, 31 reflecting plane
40 diffusion lens
50 shade
100, 110, 120, 130, 140 light emitting module
FP focal point of projection lens

What is claimed is:

1. A light emitting module for vehicle headlamp, the light emitting module comprising:

a light emitting diode having a light emitting plane disposed to direct light toward a front side of a lighting unit;

a projection lens disposed in a front side of the light emitting diode; and a reflecting surface extending in an oblique and forward direction from a side of the light emitting diode, wherein the light emitting diode has a straight brightness boundary line, wherein the projection lens has a focal point and a bottom edge of the light emitting diode is disposed at or above the focal point, wherein the reflecting surface is configured to reflect the light emitted from the light emitting diode toward a lower region from a cut line, wherein the light reflected by the reflecting surface is emitted in a forward direction without passing through said projection lens, wherein the reflecting surface, a direction of an optical axis, the focal point, and a shape of the reflecting surface are configured such that an image reflected by the reflecting surface is positioned downward from an upper side of the image of the projection lens, wherein the reflecting surface has an upper curved surface covering an upper side of the projection lens and a lower curved surface covering a lower side of the projection lens, and wherein a curvature of the upper curved surface is greater than a curvature of the lower curved surface.

2. The light emitting module according to claim 1, wherein the projection lens and the reflecting surface are integrally molded into one piece by a transparent resin.

3. The light emitting module according to claim 1, further comprising a diffusion lens configured to diffuse the light emitted from the light emitting diode in a horizontal direction and provided in a front side of the projection lens and the reflecting surface.

4. The light emitting module according to claim 1, wherein the light emitting plane has a rectangular shape.

5. The light emitting module according to claim 1, further comprising a shade disposed in a front side of the light emitting diode, wherein a side of the shade is disposed in a vicinity of the focal point.

6. The light emitting module according to claim 3, wherein the projection lens, the reflecting surface and the diffusion lens are integrally molded into one piece by a transparent resin.

7. The light emitting module according to claim 6, wherein the light emitting diode is molded in the one piece.

8. The light emitting module according to claim 1, wherein a bottom edge of the light emitting diode is disposed at the focal point of the projection lens.

9. The light emitting module according to claim 1, wherein a center of the light emitting diode is disposed above the focal point of the projection lens.

10. The light emitting module according to claim 1, wherein a bottom edge of the light emitting diode is disposed above the focal point of the projection lens.

11. The light emitting module according to claim 1, wherein an upper half part of the reflecting surface is configured to reflect the light emitted from the light emitting diode toward the lower region of the area defined by the cut line.

12. The light emitting module according to claim 1, wherein the entire reflecting surface is configured to reflect the light emitted from the light emitting diode toward the lower region of the area defined by the cut line.

* * * * *